United States Patent [19]

Van Engeland et al.

[11] 3,975,626

[45] Aug. 17, 1976

[54] PROCESS AND APPARATUS FOR FORMING ELECTROSTATIC CHARGE PATTERNS

[75] Inventors: Jozef Leonard Van Engeland, St. Katelijne-Waver; Arnold August Willem, Schoten, both of Belgium

[73] Assignee: AGFA-GEVAERT N.V., Mortsel, Belgium

[22] Filed: Jan. 22, 1975

[21] Appl. No.: 543,120

[30] Foreign Application Priority Data

Jan. 23, 1974 United Kingdom ..... 3200/74

[52] U.S. Cl. ..... 250/315 A; 355/3 R

[51] Int. Cl.[2] ..... G03G 13/00; G03G 15/00

[58] Field of Search ..... 250/315 A; 355/3 SC

[56] References Cited

UNITED STATES PATENTS

| | | | |
|---|---|---|---|
| 3,603,790 | 9/1971 | Cleare | 250/315 A |
| 3,710,125 | 1/1973 | Jacobs et al. | 250/315 A |

*Primary Examiner*—Alfred E. Smith
*Assistant Examiner*—T. N. Grigsby
*Attorney, Agent, or Firm*—William J. Daniel

[57] ABSTRACT

A method for producing an electrostatic charge pattern on an insulating charge-receiving member comprising the steps of:

1. depositing an electron-image or ion-image, resulting from the image-wise exposure to ionizing radiation of a means or medium capable of emitting photoelectrons, onto an electrically insulative layer of a multilayer screen consisting of an array of apertures and comprising at least a conductive screen layer and an adjacent insulative screen layer, said depositing resulting in the formation of an electrical double layer charge on opposite surfaces of the insulative layer, which double layer charge produces fringing fields within the apertures,
2. positioning the multilayer screen with its image-wise charged insulative screen layer in front of a charge-receiving material and projecting under the influence of a propulsion field charged particles of the same charge sign as the charged particles deposited on the outerside of the insulative screen layer towards the conductive screen layer, whereby by the presence of the propulsion field and said fringing fields acting as blocking fields charged particles are image-wise received on said charge-receiving material. The method is especially useful in X-ray recording using an ionizable X-ray absorbing gas as photo-electron-emitting medium.

28 Claims, 4 Drawing Figures

PROCESS AND APPARATUS FOR FORMING ELECTROSTATIC CHARGE PATTERNS

Figure 1:
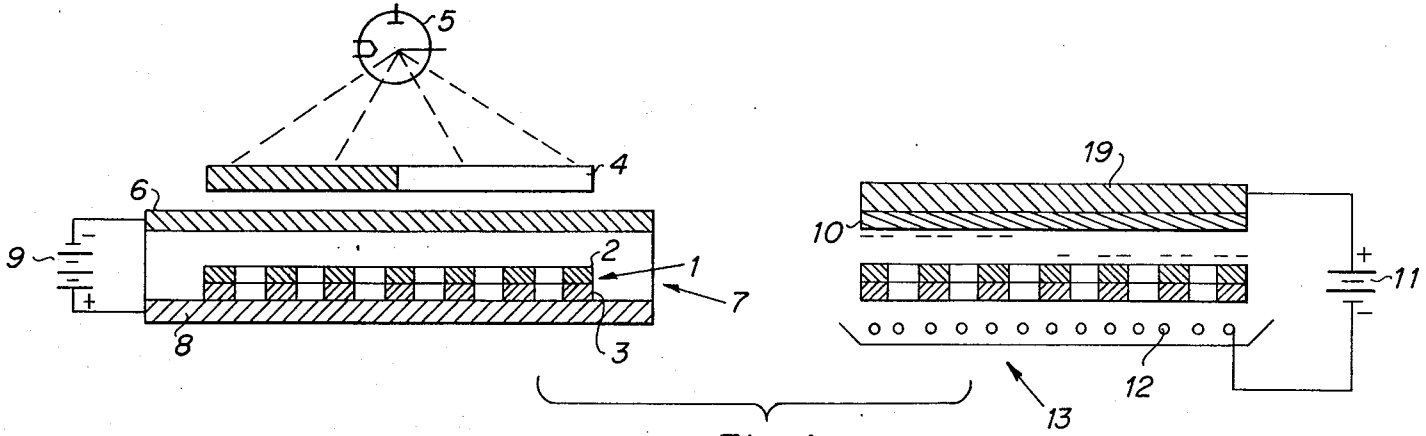

This invention relates to a process and apparatus for forming electrostatic charge patterns and the use of such charge patterns.

From the U.S. Pat. No. 3,647,291 of Gerard L. Pressman and Thomas D. Kittredge issued Mar. 7, 1972, an aperture controlled electrostatic reproduction method is known. In said method a multilayer screen consisting of an array of apertures and comprising at least a conductive layer and a superimposed insulative layer is used. The screen may be precharged to produce a uniform double-layer of charge, which is then modified in accordance with an image to produce. Alternatively, charged images of the required form may be established on previously uncharged screens. The conductive screen layer is maintained at a potential usually during charging and printing, and a propulsion field is provided for directing charged printing particles towards the screen. The particles will pass in fewer numbers or not at all through apertures that lie in areas of the screen containing charges so oriented as to produce fringing fields within the aperture, which oppose the propulsion field. Such apertures are termed blocked or partly blocked. The particles will pass through apertures that lie in uncharged areas of the screen or in areas of the screen that contain charges whose fringing fields are oriented so as to assist the passage of particles through the apertures. The latter apertures are said to contain enhancing fields, and the charged particles pass through these apertures in greater numbers. So, this process uses a charge pattern, which modulates the flow of charged particles, such as toner particles or ions, e.g. produced by a corona discharge apparatus. The obtained particle pattern is directed to a receiving medium, e.g. for forming thereon a visible image or electrostatic charge pattern.

A method relating to the formation of an electrostatic charge image by screen-modulated-charging as described in the U.S. Pat. No. 3,713,734 of Hervitt D. Crane, Gerald L. Pressman and George J. Eilers, issued Jan. 30, 1973, provides an improved screen including four layers. On the upstream face of the screen, i.e. the side facing the charged particle source of which the charged particle stream has to be modulated, the composite screen has an outer conductive layer with an adjacent insulating layer. That insulating layer is adjacent to a second conductive layer having applied thereto an outer insulating layer, which is optionally photoconductive. The improved screen is incorporated into the imaging system by biasing the two conductive layers in such a way that within the apertures an electrostatic blocking field is established that has a polarity and magnitude sufficient to block the passage of toner particles or ions through the apertures.

The outer insulating layer being optionally photoconductive obtains an image-wise distributed charge having a polarity and magnitude sufficient to form a field that counteracts and overrides portions of the blocking field to afford passage of toner particles or ions in a pattern corresponding to an image. When using an outer photoconductive insulating layer said layer is charged overall to a polarity and magnitude sufficient to create fields within the apertures that override or counteract the abovementioned blocking field. Consequently, when the screen is in a dark state, all apertures are biased to permit passage of charged particles. The image to be copied on the medium is then projected on the photoconductive insulating layer so that portions of that layer corresponding to light parts of the image assume a conductive state. In such state, the charge previously formed on the photoconductive layer is discharged image-wise thereby correspondingly discharging the counteracting field to permit the blocking field to become effective in the image-wise modulation of the flow of charged particles to a receiving medium.

The above discussed electrostatic imaging systems operate with a photoconductor as photosensitive member. It is generally known that presently available photoconductors are poorly X-ray sensitive at best. Therefore said recording techniques using image-wise exposed photoconductive screens will not operate with high speed when used in X-ray recording.

The present invention provides an electroradiographic process comprising screen-aperture controlled charging whereby visible images can be produced with a particularly low X-ray dose when compared with other electroradiographic processes. The image-wise charging of the screen proceeds through ionography or photo-electron emission.

By the term radiography we designate a recording technique that makes use of penetrating radiation, which includes ionizing radiation such as X-rays, $\beta$-rays, $\gamma$-rays, and fast electrons.

In X-ray ionography effective photo-electron emitting substances are known for producing an electrostatic charge pattern. For example, a particularly interesting ionographic X-ray system has been described in the U.S. Pat. No. 3,774,029 of Eric P. Muntz, Andrew P. Proudian and Paul B. Scott, issued Nov. 20, 1973. According to the process described herein an electrostatic charge pattern is formed on a dielectric sheet in an imaging chamber comprising between electrodes an interspace filled with a gas having an atomic number of at least 36, e.g. xenon, that is kept at a pressure above atmospheric pressure. During the image-wise X-ray exposure a potential difference is applied between the electrodes and electrons and positive ions formed in said interspace are attracted and move towards the anode and cathode respectively whereby a charge pattern is formed with one of the types of charged particles on said dielectric sheet.

Other processes in which the electrostatic image formation is based on photo-electron emission are described in the U.S. Pat. Nos. 2,221,776 of Chester F. Carlson issued Nov. 19, 1940 and 3,526,767 of Walter Roth and Alex F. Jvirblis issued Sept. 1, 1970, the United Kingdom Pat. No. 778,330 filed Apr. 15, 1955 by Cie Franc. Thomsen-Houston, the German Pat. No. 1,497,093 filed Nov. 8, 1962 by Siemens A.G., the published German Patent Application Nos. 2,231,954 filed June 29, 1972 by Diagnostic Instruments and 2,233,538 filed July 7, 1972 by Diagnostic Instruments, and the U.S. Pat. Nos. 2,692,948 of Kurt S. Lion issued Oct. 26, 1954, 2,900,515 of Edward L. Criscuolo and Donald T. O'Connor issued Aug. 18, 1959 and 3,057,997 of Edward K. Kaprelian issued Oct. 9, 1962. Except for the processes described in the latter three patents the photoelectron emission proceeds with a solid photocathode. Usually photo-electron-emission is followed by an electronavalanching in the gas- or air-filled interspace separating the electrodes. Electron-avalanching, however, impairs the image sharpness so that according to the U.S. Pat. No. 3,828,191 of James Richard Eseke, Arthur Lee Morsell, Eric Philip Muntz and Murray Samuel Welkowsky issued Aug. 6, 1974, preference is given to work in the non-avalanching part of the Townsend curve, which is the curve representing discharge current versus applied voltage.

Although in the present disclosure reference is made to "charges" resulting from electrons (both photo-electrons and secondary emission electrons) this term is not intended to be limited thereto, since the charge pattern may be built up by electrons and/or ions.

The method for producing an electrostatic charge pattern on an insulating charge-receiving member according to the present invention comprises the steps of:

1. depositing an electron-image or ion-image, resulting from an image-wise exposure to ionizing radiation of a means e.g. a photocathode or medium e.g. a gas capable of emitting photoelectrons, onto an electrically insulative layer of a multilayer screen consisting of an array of apertures and comprising at least a conductive screen layer and an adjacent insulative screen layer, said depositing resulting in the formation of an electrical double layer charge on opposite surfaces of the insulative layer, which double layer charge produces fringing fields within the apertures, 2. positioning the multilayer screen with its image-wise charged insulative screen layer in front of a chargereceiving material and projecting under the influence of a propulsion field charged particles of the same charge sign as the charged particles deposited on the outerside of the insulative screen layer towards the conductive screen layer, whereby by the presence of the propulsion field and said fringing fields acting as blocking fields charged particles are image-wise received on said charge-receiving material.

According to a modified embodiment before step (1) the insulative screen layer is charged overall with charged particles having a charge sign opposite to that of the particles deposited image-wise in said step (1).

According to an other embodiment the production of the electrostatic charge pattern on the insulating chargereceiving member proceeds with a composite screen having four superposed layers, a first layer being an outer layer that is electrically insulating, a second layer that is electrically conductive and adjacent to the first layer, a third layer that is electrically insulating and adjacent to the second layer and a fourth layer being an outer layer that is electrically conductive and adjacent to the third layer, in said method in a first step (A) the first insulative screen layer is image-wise charged and during said charging the two conductive layers are biased with a DC potential source to such a degree that within the apertures of the screen an electrostatic blocking field is established that is counteracted by the field of the image-wise applied charge on the outer insulative screen layer, in a second step (B) the multilayer screen is positioned with its outer insulative screen layer in front of a charge receiving material and under the influence of a propulsion field charged particles of opposite charge sign with respect to the charged particles present on the outer insulative screen layer are projected towards the outer conductive screen layer, during that step (B) the two conductive screen layers ar biased so that the polarity and magnitude of the field resulting therefrom is sufficient to block the passage of charged particles through the apertures of the screen in the array in which no or substantially no charge is present on the outer insulative screen layer.

The last mentioned embodiment can be modified in that before step (A) the outer insulative screen layer is charged overall with charged particles having a charge sign opposite to that of the particles deposited image-wise in said step (A).

The present invention includes further an apparatus suited for forming an electrostatic charge pattern by an image-wise screen modulated deposition of charged particles, wherein said apparatus comprises in operative relationship:

A. a means being a composite screen consisting of an array of apertures for allowing when being in electrical neutral state the passage of charged particles, said screen comprising at least a conductive screen layer and an adjacent insulative screen layer;

B. a means capable of applying an electricl potential level to the conductive layer;

C. a means capable of image-wise electrostatically charging or discharging the insulative layer with charged particles generated in a photo-electron emitting member or medium;

D. a means capable of producing and/or supplying and projecting charged particles towards the screen after the operative effect thereon of the means (B) and (C);

E. a means capable of arranging the screen and a chargereceiving material in such position to each other that said charged particles mentioned under (D) and that succeed to pass apertures of the screen are received image-wise by said receiving material.

According to a special embodiment in said apparatus, the composite screen has four superposed layers, a first layer being an outer layer that is electrically insulating, a second layer that is electrically conductive and adjacent to the first layer, a third layer that is electrically insulating and adjacent to the second layer and a fourth layer being an outer layer that is electrically conductive and adjacent to the third layer.

For use in a special embodiment the apparatus comprises a corona discharge device in charging relation to the composite screen. The corona discharge device is positioned in the apparatus in operable condition before the above mentioned means (C).

According to a preferred embodiment the outer insulative screen layer of the multilayer screen is photoconductive and is capable of obtaining an increase in conductivity by exposure to ultraviolet radiation and/or visible light.

Figure 2:
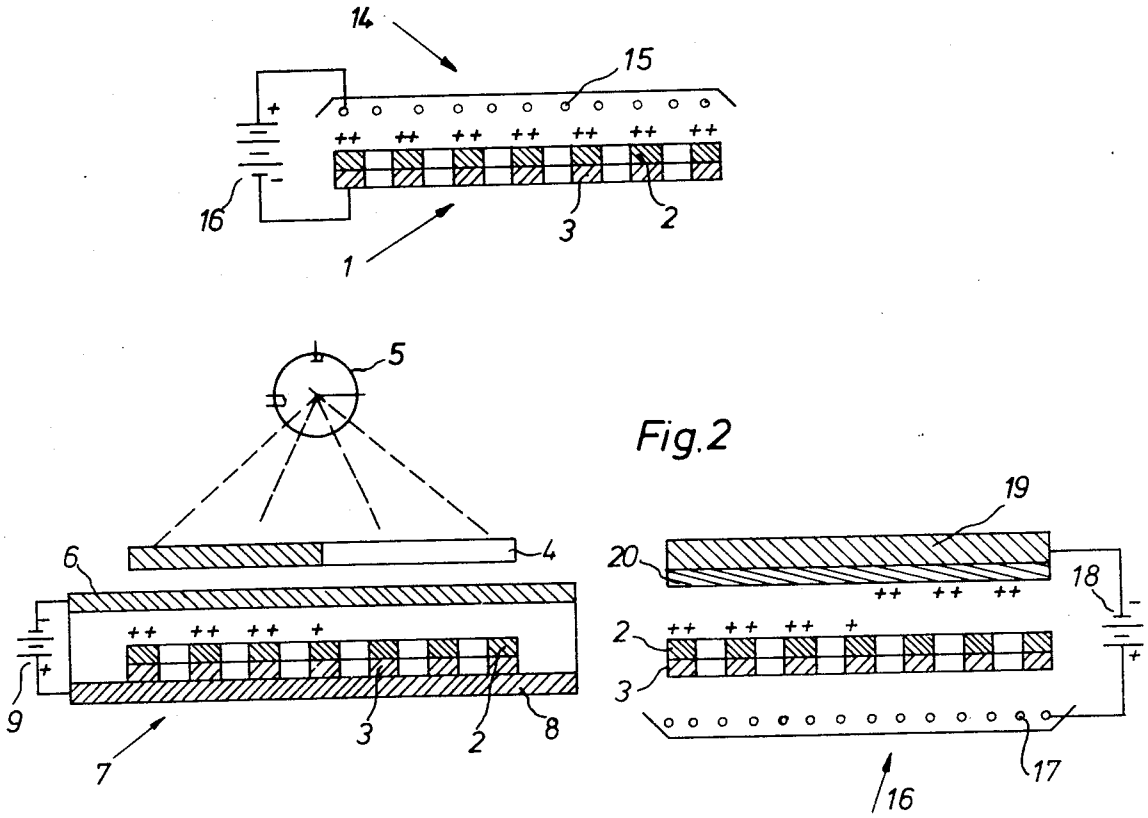
Figure 3:
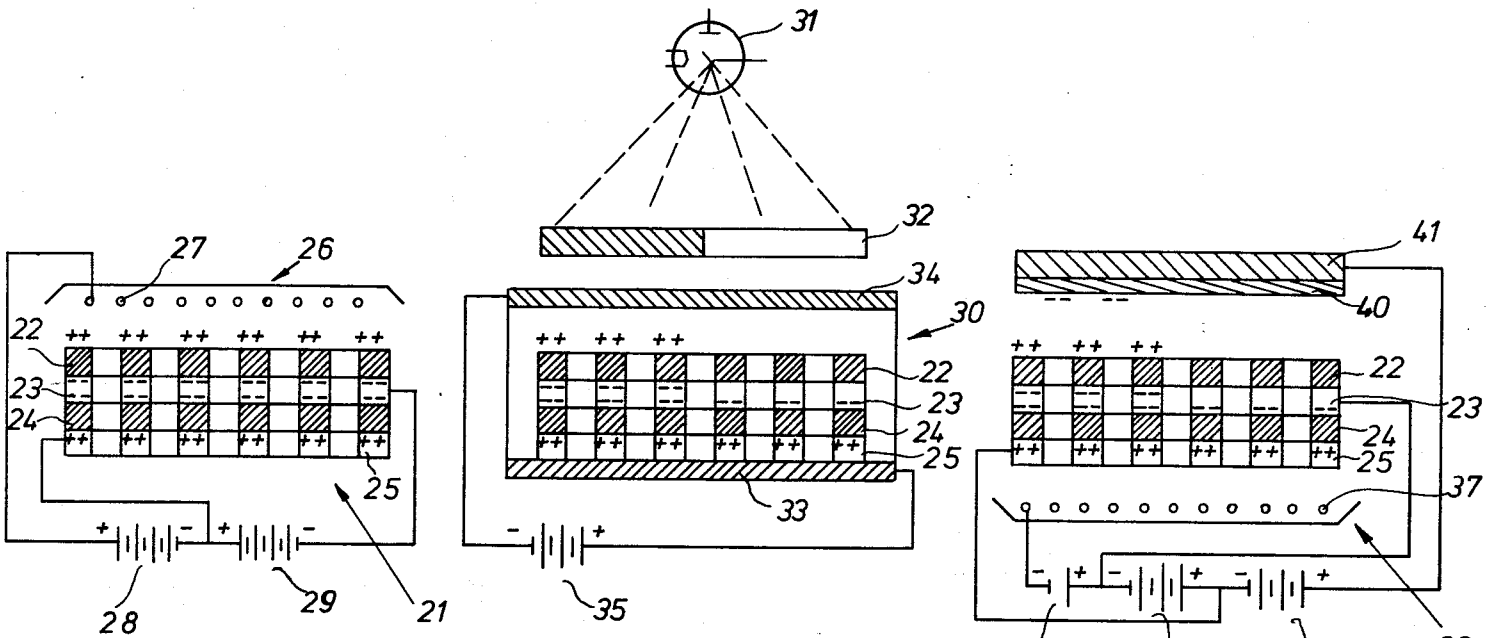

The invention is illustrated by the accompanying drawings in which FIG. 1 to 3 each represents an embodiment of the recording system of the invention using a charging modulating screen structure.

Figure 4:
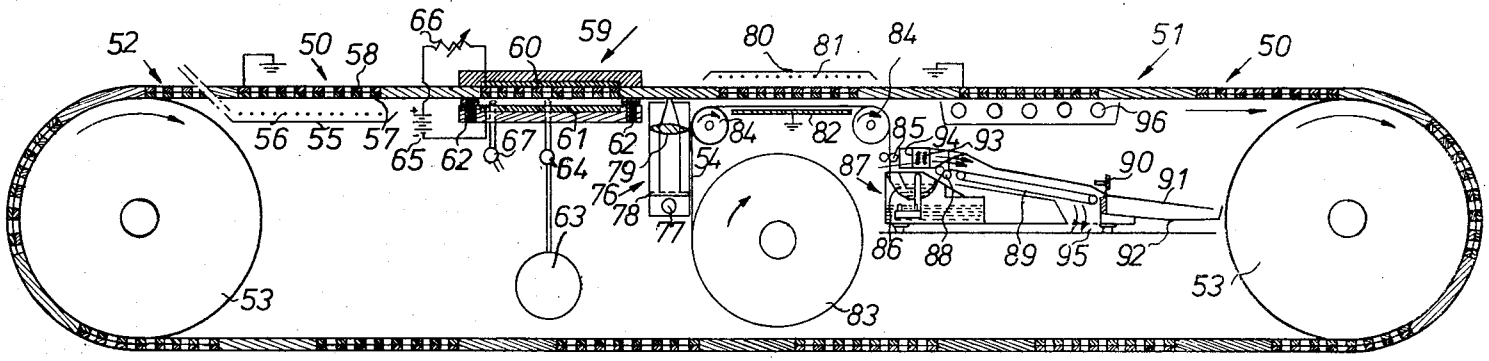

FIG. 4 relates to a particular recording apparatus of the present invention in which an X-ray-absorbing gas is used as photoelectron-emitting medium and a composite screen having a photoconductive insulating layer coated onto a conductive wire support is used as charging modulating member.

It should be understood that in these figures some dimensions of the screen layers, gas interspace, imaging chamber electrodes, etc., have been greatly exaggerated in order to show the details of the construction. The recording apparatus of FIG. 4 contains the different work stations of the apparatus in an arrangement that clearly illustrates the sequential order of the processing steps.

No inferences should be drawn as to the relative dimensions of the layers or spacings separating the various elemental parts of the imaging apparatus.

According to the embodiment represented in FIG. 1 the recording of an X-ray image proceeds with a screen 1 having a screen insulative layer 2 and a contacting conductive screen layer 3. The screen insulative layer 2 is optionally photoconductive.

The image-wise X-ray exposure proceeds through an original 4 with the X-ray exposure source 5. The image-wise modulated X-rays are projected through the cathode 6 in an ionizable gas contained in the imaging chamber 7. During the X-ray exposure the double layer screen 1 stands with its conductive screen layer 3 in contact with the anode 8 of the imaging chamber 7. In the imaging chamber 7 between the cathode 6 and anode 8 photo-electrons are formed in the X-ray-absorbing ionizable gas medium containing, e.g. xenon.

The image-wise formed photoelectrons and also the optionally formed secondary emission electrons are directed to the anode 8 under the influence of the potential difference maintained by the DC voltage source 9 and deposited on the insulating screen layer 2.

Following the image-wise X-ray exposure the screen 7 is used to modulate the charging of an insulating receiving material 10, e.g. insulating resin film, that stands in contact with a positive electrode plate 19, which through a DC voltage source 11 is connected to the negative corona wires 12 of a corona-discharge apparatus 13.

The fringing fields of the screen 1 corresponding with the image-wise negatively charged areas prevent in these areas the pass through of the negative ions of the corona, so that the insulating receiving material becomes only charged in correspondence with the areas of the original 4 that are not transparent or less transparent for X-rays. Operating that way a positive X-ray image of the original 4 is obtained.

The formation of a negative X-ray image is illustrated with FIG. 2.

According to the embodiment represented in said FIG. 2 before entering the imaging chamber 7 the insulating screen layer 2 of the screen 1 is non-differentially charged with a positive corona discharge device 14 of which the corona wires 15 over a DC voltage source 16 are connected to the electrically conductive screen layer 3.

The screen 1 containing the overall positively charged insulating screen layer 2 is put in the imaging chamber 7 with its conductive screen layer 3 in contact with the anode 8. The X-ray exposure proceeds as described in connection with FIG. 1. The positive charge on the insulating layer 2 is neutralized with the image-wise produced photoelectrons (and optionally also secondary emission electrons). A charge pattern of non-neutralized charge particles corresponding with the non-transparent or less transparent areas of the original 4 is obtained on the insulating screen layer 2.

Following the image-wise neutralizaton of the positive charge on the insulating screen layer 2 the screen 1 is taken from the imaging chamber 7 and positioned with its conductive screen layer 3 in front of a positive corona discharge apparatus 16 the wires 17 of which are connected through the DC voltage source 18 to a conductive electrode plate 19 on which an insulating charge receiving member 20 e.g. polyester resin sheet is arranged facing the insulating screen layer 2.

The fringing fields of the screen 1 corresponding with the positively charged area of the insulating screen layer 2 prevent in these area the pass through of the positive ions of the corona, so that the insulating receiving material becomes only charged in correspondence with the areas of the original that are more transparent for X-rays. Operating that way a negative X-ray image of the original is obtained.

According to the embodiment represented in FIG. 3 the recording of an X-ray image proceeds with a composite screen 21 having four superposed layers.

A first layer 22 being electrically insulating and optionally photoconductive serves as charge receiving layer. The second layer 23 is an electrically conductive layer. That layer is coated with an insulating layer 24, which stands in contact with an outer electrically conductive layer 25. Screens of that type are described in the U.S. Pat. Spec. No. 3,713,734, as mentioned hereinbefore.

In a first step the insulating screen layer 22 is charged with a positive corona discharge apparatus 26 of which the corona wires 27 are connected to the positive pole of the DC voltage source 28.

During the overall charging of the insulating screen layer 22 the two conductive layers 23 and 25 are biased with the DC potential source 29 so that within the apertures of the screen an electrostatic blocking field is established. The polarity and magnitude of that field are sufficient to block the passage of negative ions of a corona discharge through the apertures of the screen 21.

The outer insulating screen layer 22 is overall electrostatically charged to positive polarity and magnitude of positive charge sufficient to form a field that counteracts and overrides the blocking field in order to afford passage of negative ions through the apertures of the screen 21.

In a second step the thus charged and biased screen 21 is put into an imaging chamber 30. During the X-ray exposure with the X-ray exposure source 31 through the original 32, the conductive screen layer 25 stands in contact with the anode 33 while the insulating charged screen layer 22 is facing the cathode 34. Between the cathode 34 and anode 33 a potential difference is maintained with the DC voltage source 35. The imaging chamber 30 contains an ionizable gas of the type described in the U.S. Pat. No. 3,774,029, as already mentioned hereinbefore. The gas is kept at a pressure above atmospheric pressure. The potential difference between the cathode 34 and anode 33 directs the image-wise formed photoelectrons to the positively charged insulating screen layer 22 whereby the charge of that layer is neutralized image-wise.

In a third step the image-wise charged screen 21 with its outer conductive screen layer 25 is put in front of a negative corona charging device 36 the wires 37 of which are connected to the negative pole of the DC voltage source 38. The two conductive screen layers 23 and 25 are biased with the DC potential source 39 in such a way that the polarity and magnitude of the field resulting therefrom are sufficient to block the passage of negative ions through the apertures of the screen 21. The residual positive charge pattern on the insulating screen layer 22 is, however, of sufficient magnitude to form an image-wise field that counteracts and overrides the blocking field to afford image-wise passage to the negative ions of the corona device 36. The negative ions are received by an insulating receptor member 40 whose rear side stands in contact with an electrode 41. The electrode 41 is connected to the positive pole of the DC voltage source 42.

In FIG. 4, a cross-sectional representation of a particular X-ray photographic apparatus of the present invention is illustrated.

The recording and reproducing of X-ray information with said apparatus proceeds with a weblike arrangement of composite screens of the type illustrated by screen 1 in FIG. 1. The screens 50 are framelike incorporated in an electrically insulating flexible endless belt material 51, e.g. of synthetic resin or rubber, in which windowlike openings are filled up by the screens. The fixing of the screens 50 to the web material 51 may proceed by fusion techniques so that a seamless endless belt 52 is obtained. The endless belt 52 is moved around two supporting rollers 53 or wheels of which at least one is driven, e.g., with an electric motor (not shown in the drawing). The apparatus yields in four stages a visible image on an electrically insulating receiving material 54.

In the first stage a screen 50 of the belt 52 is nondifferentially charged with a corona device 55 of which the wires 56 have a positive potential with respect to the ground. With said corona device 55 the photoconductive insulating screen layer 57 of the screen 50 obtains a positive charge. The electrically conductive screen layer 58 is connected to the ground.

In the second stage the positively charged screen 50 is introduced into the imaging chamber 59 in which in the interspace between a cathode 60 and an anode 61 an X-ray-absorbing ionizable gas containing, e.g., mainly xenon is present. During the introduction of the screens 50 into the chamber 59 the gas is kept at atmospheric pressure. The chamber 59 is closed with the aid of a sealing means 62 and xenon gas is introduced from a reservoir 63 through a pressure relief valve 64 until a superatmospheric pressure is reached in the chamber 59. The X-ray exposure is sufficient while having the gas at said pressure above atmospheric pressure, e.g., of 7 kg per sq.cm. The X-ray exposure through the body or object to be radiographed is carried out with an X-ray exposure source (not shown in the drawing), which is directed to the cathode 60.

During the X-ray exposure a potential difference is maintained between the cathode 60 and anode 61 with the DC-voltage source 65. The voltage is adjustable with a variable resistor 66. The latter preferably adjusts the voltage at a value that allows to operate the imaging chamber 59 in the horizontal part of the Townsend curve (current versus voltage).

After the X-ray exposure the pressure in the imaging chamber is reduced through the valve 67 in order to limit the loss of ionizable gas during the exit transport of the screen 50.

On leaving the imaging chamber 59 the screen 50 containing an image-wise charge pattern of positive charge particles corresponding with the areas of the original being nontransparent or less transparent to X-rays (see FIG. 2) is moved in front of an exposure device 76. In a direct or reflectographic exposure the identification marks comprising particulars about the radiographed object (in medical X-ray, e.g., particulars about the patient and the position of the radiographed body part) are printed by means of said exposure device onto the photoconductive insulating screen layer 57.

For that purpose the screen layer 57 contains a photoconductor that is practically not X-ray-sensitive but is sensitive to ultraviolet radiation and/or visible light. The ultraviolet radiation and/or visible light exposure proceeds in the present FIG. 4 with a flash lamp 77 that projects its light through the identification card 78 and the focussing lens 79 onto a still positively charged margin area of the screen layer 57.

Thereupon, in the third stage, the screen 50 is positioned under a positive corona discharge device 80 of which the wires 81 have a positive potential with respect to the electrode plate 82 that is connected to the ground.

The fringing fields of the screens 50 corresponding with the positively charged area of the photoconductive insulating screen layer 57 prevent in these area the pass through of the positive ions of the corona, so that the insulating charge-receiving material 54, e.g. an insulating resin web coated with a transparent conductive backing layer, becomes only charged in correspondence with the areas or parts of the radiographed object that are more transparent to X-rays.

In the fourth stage the insulating material 54, which according to the embodiment of FIG. 4 is in web form, is taken off the supply reel 83, moved around guiding rollers 84 and with the aid of the pressure rollers 85 introduced into the electrophoretic developing liquid contained in the tray 86 of the developing device 87.

The electrophoretic developing device 87 represented in FIG. 4 is of the type used in the GEVAFAX 50 copying apparatus (FEVAFAX is a registered trade name of the Applicant).

On leaving the developing tray 86 the web material 54 passes between two pressure transport rollers 88 and is carried and supported by a conveyor belt 89. The web material 54 is cut with the knife 90 and is received in the form of sheets 91 in the receptor tray 92. While carried by the conveyor belt 89, air heated by electric filament 93 strikes over the developed image and dries and fixes the image-wise deposited toner substance on the material 54. The air enters the developing device through the inlet 94 and leaves the apparatus through the outlet 95.

In the embodiment represented in FIG. 4 an overall photo-exposure stage is applied in order to carry off the charge pattern from the photoconductive insulating screen layer 57. This procedure enables the re-use of the selected screen 50 in the above described stages 1 to 3.

The screen layer 57 is exposed with a number of fluorescent lamps 96 emitting ultraviolet radiation and/or visible light, which increases the conductivity of the screen layer 57 and allows the charge pattern thereon to leak off to the conductive screen layer 58, which is connected to the ground.

The photoconductive insulating screen layer 57 regains its dark-resistivity after having passed the overall exposure stage.

According to a modified embodiment (not illustrated in FIG. 4) the chargeable insulating screen layer is non-photoconductive. The residual charge pattern on that layer is destroyed by moving the layer in front of an alternating current corona.

In the above embodiments reference has been made to composite screen structures that are corona-shaped at one side only. A composite screen structure having a conductive screen support or layer coated on both sides with an electrically insulating layer may be double-charged. In the latter case, positive and negative corona sources may be used to spray the outer insulating layers of the screen from opposite sides. The insulating layer may be photoconductive but need not be photoconductive.

The screens may have different configurations but all are characterized by an array of apertures therethrough to permit ion passage. The arrangement, size and shape of the apertures may vary from mesh to parallel lines or slots.

In the screen the apertures may be distributed in a random fashion and may have randomly distributed size and irregular shape as well. For example, the screen may consist of the uniform array of circular apertures in a square or 90° pattern. Alternatively, the apertures being circular are arranged in a triangular or 60° distribution. According to another embodiment the apertures are square and arranged in a square or 90° pattern or consist of triangular holes arranged in a triangular pattern, or consist of hexagonal holes arranged in a hexagonal pattern. It is also possible that the screen is composed of a distribution of wires, which may be woven into a mesh as represented in FIG. 61 (h) of the U.S. Pat. No. 3,647,291, as already mentioned hereinbefore. When woven material is employed as the composite screen, the insulation is mounded on top of the strands.

In its preferred form the screen used in the invention is mounted for endless movement and has at least an insulative and conductive layer with coinciding mesh.

The insulating screen layer is of sufficient thickness compared to the hole diameter in order to produce a repulsive field within the holes when a double layer charge is modified in accordance with the image. The conductive layer, directly or indirectly connected to the insulator layer, provides double layer charging of the insulator.

The conductive screen layer, when maintained at a constant potential during the ion projection of the corona, limits the discharging effect by shielding the insulative screen layer and absorbing the ion particles. The propulsion field between the conductive screen layer and the electrode backing the insulating charge receiving material is of sufficient magnitude to cause the ions to pass through the uncharged areas of the screen, but has insufficient force to cause the particles to pass through charged areas of the screen. The holes that have no sufficient charge to completely block the screen material act as holes of reduced aperture thereby permitting the reproduction of continuous tone gray scale, as in halftone printing.

The weakest fringing field exists along the center of the hole and the magnitude of this field depends on both the charge magnitude (strength of the field inside the insulator) and the thickness-to-diameter ratio (T/D) for the screen to aperture. Since the fringing field increases in strength as the insulator thickness increases, it is clear that for efficient blocking a large ratio of T/D as well as high charge level is desirable. The amount of fringing field required to block the charged particles depends on the strength of the field used to propel the particles from the source to the receiving material. If the particles had no inertia, blocking would occur if the combination of fringing field and the propulsion field (which act in opposition) produce a net zero field or repulsive field at any point along the centerline of the hole.

As described in the U.S. Pat. No. 3,674,291, as already mentioned hereinbefore, prototype designs have indicated that the internal field in the insulator should be at least 8 to 10 times the propulsion field if the T/D ratio is 0.25. Thus, for a screen with 0.008 inch diameter holes, an insulator thickness of 0.002 inch, and a propulsion field of 5,000 V/inch, the screen should be charged to a potential of 100 V.

A wide choice is available in connection with the electrically conductive grid which forms e.g. the support of the insulative layer. The conductive screen layer or support may be made e.g. of copper, brass, aluminum, steel, nickel or tungsten. The choice as to the shape, size, material and method of manufacture is large. It has been established experimentally that an etched or electroformed grid or mesh is particularly suitable for application in rigid screen plates. Woven mesh is preferred for producing a completely flexible belt as represented in FIG. 4.

The rigid screen plates may be arranged into an endless belt by flexible material acting as hinges. The dimensional stability of the apertures is better by the use of rigid screen plates, e.g. arranged in a rigid frame with hinges in an endless belt, then by the use of flexible woven screen web material.

A layer of insulating material that is optionally photoconductive may be formed on the conductive grid, for example, by evaporation techniques or by spray coating.

The insulating material may be any resin material known as insulating binder in electrophotographic zinc oxide recording layers.

The insulating material may be photoconductive so that many kinds of photoconductors (n and p types) or superposed (n and p type photoconductor layers) can be used. Photoconductors for use in the above embodiments illustrated with the FIG. 1–4 have a low X-ray sensitivity. Therefore, preferably organic photoconductors, which may be organic polymeric photoconductors, are used, e.g., copolymers of N-vinylcarbazole and low molecular weight organic photoconductors, which form a solid solution in an insulating binder.

Solid solutions in a binder of organic photoconductors in which atoms or groups of different electron-affinity are linked by a conjugated system are particularly useful for the manufacture of the photoconductive screen layers. Examples of such organic photoconductors are 2,5-bis(p-diethylaminophenyl)-1,3,4-oxadiazole, 2,5-bis(p-diethylaminophenyl)-1,3,4-triazole, 2,4,5,7-tetranitro-9-fluorenone, the quinoline derivatives described in the published German Patent Application No. 20 13 410 filed Mar. 20, 1970 by Agfa-Gevaert A.G., the dihydro- and tetrahydroquinoline derivatives described in the published German Patent Application Nos. (DOS) 2,159,804 filed Dec. 11, 1970, 2,160,873 filed Dec. 8, 1971 and 2,254,573 filed Nov. 8, 1972, all by Agfa-Gavaert A.G.

Another useful type of photoconductor is based on so-called charge-transfer complexes between electron-donating or "Lewis-base" resins and electron-accepting or "Lewis-acid" solutions. For example, the resin poly(N-vinylcarbazole) can be coated on a conductive substrate with compounds such as anhydrides, fluorenones, quinones and/or acids dissolved in it.

The coatings of said solid solutions or organic photoconductors are essentially grainless.

The screen-modulated charge pattern may be received on any type of material having an electrically insulating surface. For that purpose so-called electrographic recording materials are particularly suited. Such a recording material is, e.g., a recording web consisting of an insulating coating of plastic on a paper base having sufficient conductivity to allow electric charge to flow from the backing electrode to the paper-plastic interface.

In X-ray recording preference is given to a transparent resin film as charge-receiving material. Such resin films have preferably a transparent rear side coating for making intimate electric contact with a backing electrode.

As substances suited for enhancing the conductivity of the rear side of a transparent resin web or sheet are particularly mentioned antistatic agents preferably antistatic agents of the polyionic type, e.g. CALGON CONDUCTIVE POLYMER 261 (trade mark of Calgon Corporation, Inc. Pittsburgh, Pa., U.S.A.) for a solution containing 39.1% by weight of active conductive solids, which contain a conductive polymer having recurring units of the following type:

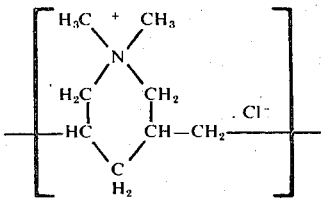

and vapour deposited films of chromium or nickel-chromium about 3.5 μm thick and that are about 65 to 70% transparent in the visible range.

Copper(I) iodide conducting films can be made by vacuum depositing copper on a relatively thick resin base and treating it with iodine vapour under controlled conditions (see J. Electrochem. Soc., 110–119, Feb. 1963). Such films are over 90% transparent and have surface resistivities as low as 1500 ohms per square. The conducting film may be overcoated with a relatively thin insulating layer as described e.g. in the J. SMPTE, Vol. 74, p. 667.

We claim:

1. A method for producing an electrostatic charge pattern on an insulating charge-receiving member comprising the steps of:

1. depositing an electron-image or ion-image, resulting from the image-wise exposure to ionizing radiation of a means or medium capable of emitting photoelectrons, onto an electrically insulative layer of a multilayer screen consisting of an array of apertures and comprising at least a conductive screen layer and an adjacent insulative screen layer, said depositing resulting in the formation of an electrical double layer charge on opposite surfaces of the insulative layer, which double layer charge produces fringing fields within the apertures,
2. positioning the multilayer screen with its image-wise charged insulative screen layer in front of a charge-receiving material and projecting under the influence of a propulsion field charged particles of the same charge sign as the charged particles deposited on the outerside of the insulative screen layer towards the conductive screen layer, whereby by the presence of the propulsion field and said fringing fields acting as blocking fields charged particles are image-wise received on said charge-receiving material.

2. A method according to claim 1, with the modification that before step (1) the insulative screen layer is charged overall with charged particles having a charge sign opposite to that of the particles deposited image-wise in said step (1).

3. A method according to claim 1, with the modification that the production of the electrostatic charge pattern on the insulating charge receiving member proceeds with a composite screen having four superposed layers, a first layer being an outer layer that is electrically insulating, a second layer that is electrically conductive and adjacent to the first layer, a third layer that is electrically insulating and adjacent to the second layer and a fourth layer being an outer layer that is electrically conductive and adjacent to the third layer, in said method in a first step (A) the first insulative screen layer is image-wise charged via said photoelectron emission and during said charging the two conductive layers are biased with a DC potential source to such a degree that within the apertures of the screen an electrostatic blocking field is established that is counteracted by the field of the image-wise applied charge on the outer insulative screen layer, in a second step (B) the multilayer screen is positioned with its outer insulative screen layer in front of a charge receiving material and under the influence of a propulsion field charged particles of opposite charge sign with respect to the charged particles present on the outer insulative screen layer are projected towards the outer conductive screen layer, during that step (B) the two conductive screen layers are biased so that the polarity and magnitude of the field resulting therefrom is sufficient to block the passage of charged particles through the apertures of the screen in the array in which no or substantially no charge is present on the outer insulative screen layer.

4. A method according to claim 3, with the modification that before step (A) the outer insulative screen layer is charged overall with charged particles having a charge sign opposite to that of the particles deposited image-wise in said step (A).

5. A method according to claim 1, wherein the photo-electrons are generated by an image-wise exposure with ionizing radiation of a photoelectron-emitting gas contained in an imaging chamber in the interspace between two electrodes.

6. A method according to claim 5, wherein the photoelectron-emitting gas has an atomic number of at least 36.

7. A method according to claim 6, wherein the gas is xenon.

8. A method according to claim 6, wherein the gas during the exposure to ionizing radiation is kept at a pressure above atmospheric pressure.

9. A method according to claim 1, wherein the image-wise exposure is an image-wise X-ray exposure.

10. A method according to claim 1, wherein the outer insulative screen layer of the multilayer screen is photoconductive but poorly sensitive to X-rays.

11. A method according to claim 10, wherein after the image-wise receipt of charged particles on the chargereceiving material, the outer photoconductive insulative screen layer of the multilayer screen is photoexposed overall to electromagnetic radiation increasing the conductivity of said screen layer and the residual charge pattern is carried off through the adjacent conductive screen layer.

12. A method according to claim 1, wherein after the image-wise receipt of charged particles on the charge-receiving material, the outer insulative screen layer is subjected to an alternating current corona discharge treatment.

13. A method according to claim 1, wherein the charged particles projected in step (2) are ions produced by an ion source including corona discharge electrodes.

14. A method according to claim 1, wherein the electrostatic charge pattern on the electrically insulating material is developed with electrostatically attractable material.

15. Apparatus suited for forming an electrostatic charge pattern by an image-wise screen modulated deposition of charged particles, wherein said apparatus comprises in operative relationship:

A. a means being a composite screen consisting of an array of apertures for allowing the passage of charged particles, when being in electrical neutral state, said screen comprising at least a conductive screen layer and an adjacent insulative screen layer;

B. a means capable of applying an electric potential level to the conductive layer;

C. a means capable of image-wise electrostatically charging or discharging the insulative layer with charged particles generated in response to ionizing radiation in a photoelectron-emitting means or medium;

D. a means capable of producing and/or supplying and projecting charged particles towards the screen after the operative effect thereon of the means (B) and (C); and E. a means capable of arranging the screen and a chargereceiving material in such position to each other that said charged particles mentioned under (D) and that succeed to pass apertures of the screen are received image-wise by said receiving material.

16. Apparatus according to claim 15, wherein said composite screen has four superposed layers, a first layer being an outer layer that is electrically insulating, a second layer that is electrically conductive and adjacent to the first layer, a third layer that is electrically insulating and adjacent to the second layer and a fourth layer being an outer layer that is electrically conductive and adjacent to the third layer.

17. Apparatus according to claim 15, wherein said apparatus comprises a corona discharge device in charging relation to the composite screen and said device is positioned in the apparatus in operable condition before the means (C).

18. Apparatus according to claim 16, wherein the two conductive screen layers are conducted to a DC voltage biasing means.

19. Apparatus according to claim 15, wherein in said apparatus the means (D) is a corona discharge device and the apparatus comprises a transport means to transport the multilayer screen from the photoelectron-emitting means or medium to a position in front of said corona device.

20. Apparatus according to claim 15, wherein the outer insulative screen layer of the multilayer screen is photoconductive and obtains an increase in conductivity by exposure to ultraviolet radiation and/or visible light.

21. Apparatus according to claim 20, wherein the apparatus comprises an exposure source emitting ultraviolet radiation and/or visible light and said source is positioned in the apparatus in operable condition after the means (D).

22. Apparatus according to claim 15, wherein the apparatus comprises an alternating current corona device for projecting charged particles towards the composite screen after the operation with means (D) has been effected.

23. Apparatus according to claim 15, wherein the conductive screen layer(s) serve(s) as the support for the insulative screen layer.

24. Apparatus according to claim 15, wherein the means and/or medium capable of photoelectron emission comprises a gas capable of photoelectron-emission by exposure to X-rays.

25. Apparatus according to claim 15, wherein said imaging chamber contains an anode and a cathode between which the screen is positionable.

26. Apparatus according to claim 25, wherein said anode and cathode are connected to a DC voltage source.

27. Apparatus according to claim 15, wherein the apparatus contains said electrically insulating charge receiving material in web or sheet form and a means (E) capable of positioning said material in front of the composite screen and contains a further means capable of transporting that material through a developing station and a fixing station of an electrostatic image-developing device.

28. An apparatus according to claim 15, wherein said apparatus comprises an endless belt including a plurality of composite screens adapted to have an electrostatic image formed thereon, said apparatus containing in operable condition a plurality of actuable work stations including an actuable charging station operative when actuated for charging a selected screen, an actuable exposure station operative when actuated for forming an electrostatic image on the screen by photoelectron emission of a gas through X-rays, an actuable sheet or web feeder operative for feeding said sheet or web with its electrically insulating surface in front of the selected screen and an actuable charging station to direct a flow of ions to said screen when being in front of said sheet or web, and a developer station for providing electrostatically attractable material in contact with said electrically insulating surface carrying an electrostatic charge pattern.

* * * * *